US008292644B2

(12) United States Patent
Hamner et al.

(10) Patent No.: US 8,292,644 B2
(45) Date of Patent: Oct. 23, 2012

(54) CONNECTOR ASSEMBLY HAVING A FLOATING MATING ARRAY

(75) Inventors: Richard Elof Hamner, Hummelstown, PA (US); Robert Neil Mulfinger, York Haven, PA (US); Jason M'Cheyne Reisinger, Carlisle, PA (US); Attalee Snarr Taylor, Palmyra, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 278 days.

(21) Appl. No.: 12/757,835

(22) Filed: Apr. 9, 2010

(65) Prior Publication Data

US 2011/0250773 A1 Oct. 13, 2011

(51) Int. Cl.
*H01R 13/64* (2006.01)

(52) U.S. Cl. ..... 439/248

(58) Field of Classification Search ..... 439/248, 439/65, 260, 59–62, 639–630
See application file for complete search history.

(56) References Cited

U.S. PATENT DOCUMENTS

| | | | | |
|---|---|---|---|---|
| 4,085,990 | A | 4/1978 | Jayne | |
| 4,480,569 | A | 11/1984 | van der Veen et al. | |
| 4,518,210 | A | 5/1985 | Morrison | |
| 4,603,928 | A | 8/1986 | Evans | |
| 4,626,056 | A | 12/1986 | Andrews, Jr. et al. | |
| 4,629,270 | A | 12/1986 | Andrews, Jr. et al. | |
| 4,693,529 | A | 9/1987 | Stillie | |
| 4,731,698 | A | 3/1988 | Millot et al. | |
| 4,881,901 | A | 11/1989 | Mendenhall et al. | |
| 5,092,781 | A * | 3/1992 | Casciotti et al. | 439/62 |
| 5,102,342 | A * | 4/1992 | Marian | 439/65 |
| 5,171,154 | A | 12/1992 | Casciotti et al. | |
| 5,205,739 | A | 4/1993 | Malo et al. | |
| 5,228,863 | A | 7/1993 | Campbell et al. | |
| 5,248,261 | A | 9/1993 | Conroy-Wass et al. | |
| 6,062,872 | A | 5/2000 | Strange et al. | |
| 6,077,090 | A | 6/2000 | Campbell et al. | |
| 6,411,517 | B1 | 6/2002 | Babin | |
| 6,672,878 | B2 | 1/2004 | Dean | |
| 7,297,015 | B1 | 11/2007 | Desrosiers et al. | |
| 7,374,441 | B2 * | 5/2008 | Rubenstein | 439/160 |
| 7,419,400 | B1 | 9/2008 | Taylor | |
| 7,425,134 | B1 | 9/2008 | Taylor | |
| 7,438,582 | B2 | 10/2008 | Taylor | |
| 7,632,106 | B2 | 12/2009 | Nakamura | |
| 8,113,851 | B2 * | 2/2012 | Hamner et al. | 439/65 |
| 2007/0097662 | A1 | 5/2007 | Dean | |
| 2008/0227314 | A1 | 9/2008 | Taylor | |

* cited by examiner

*Primary Examiner* — Jean F Duverne

(57) ABSTRACT

A connector assembly includes a housing, a mating array, and a self-alignment subassembly. The housing is joined to a first circuit board and includes a header portion that moves in a mating direction toward a second circuit board. The mating array is joined to the header portion and includes a terminal. The mating array is moveable in the mating direction to couple the terminal with a mating terminal of the second circuit board. The self-alignment subassembly is disposed between the header portion and the mating array. The self-alignment subassembly applies a floating force on the mating array that permits alignment of the terminal of the mating array with the mating terminal while the mating array is moved in directions oriented approximately perpendicular to the mating direction. The self-alignment subassembly also applies a loading force on the mating array in the mating direction that couples the terminal of the mating array with the mating terminal.

20 Claims, 16 Drawing Sheets

CONNECTOR ASSEMBLY HAVING A FLOATING MATING ARRAY

BACKGROUND OF THE INVENTION

The subject matter herein relates generally to connectors and, more particularly, to connectors that communicatively couple circuit boards with one another.

Server systems may include several blade server circuit boards that are mounted to a backplane board. In some known server systems, the blade server circuit boards are loaded into a server box in a parallel relationship. For example, the blade server circuit boards are loaded into the server box through a front face of the box so that the blade server circuit boards are approximately parallel with respect to one another. Some known server systems include a motherboard located along a bottom side of the box. The motherboard includes connectors that mate with the blade server circuit boards such that the motherboard and blade circuit server boards are oriented perpendicular to one another. These connectors mate with the blade server circuit boards in directions that are perpendicular to the loading direction of the blade server circuit boards. The known connectors require twisting or rotation of one or more components of the connectors to mate the connectors with the blade server circuit boards. These connectors may be fairly complex and involve several interconnected components working together. If one or more components fail or becomes misaligned with one or more other components, the connectors may be unable to mate with the blade server circuit boards.

For example, the connectors may include a plate or connector interface that moves away from the connector and toward a blade server circuit board. The plate or connector interface includes terminals that mate with corresponding terminals on the blade server circuit board. The connector interface abuts against the blade server circuit board in order to mate the terminals with one another. But, if the connector interface is misaligned with the blade server circuit board, the terminals of the plate may be unable to mate with the terminals of the blade server circuit board.

Thus, a need exists for a connector assembly that includes a connector interface that is able to mate with circuit boards that are misaligned with, or angled with respect to, the connector interface.

BRIEF DESCRIPTION OF THE INVENTION

In one embodiment, a connector assembly is provided. The connector assembly includes a housing, a mating array, and a self-alignment subassembly. The housing is joined to a first circuit board and includes a header portion that moves in a mating direction toward a second circuit board. The mating array is joined to the header portion and includes a terminal. The mating array is moveable in the mating direction to couple the terminal with a mating terminal of the second circuit board. The self-alignment subassembly is disposed between the header portion and the mating array. The self-alignment subassembly applies a floating force on the mating array that permits alignment of the terminal of the mating array with the mating terminal. The self-alignment subassembly also applies a loading force on the mating array in the mating direction that couples the terminal of the mating array with the mating terminal In another embodiment, another connector assembly is provided. The connector assembly includes a housing, a mating array, a floating resilient body, and a loading resilient body. The housing has a mounting side joined to a first circuit board and a header portion that moves relative to the housing along a mating direction toward a second circuit board. The mating array is interconnected with the header portion and includes a terminal configured to couple with a mating terminal of the second circuit board. The mating array moves in the mating direction to couple the terminal with the mating terminal of the second circuit board. The floating resilient body is disposed between the mating array and the header portion and applies a floating force on the mating array in one or more directions that are oriented approximately perpendicular to the mating direction. The loading resilient body is disposed between the mating array and the header portion. The loading resilient body applies a loading force on the mating array that couples the terminal of the mating array with the mating terminal when the loading resilient body is compressed.

In another embodiment, another connector assembly is provided. The connector assembly includes a housing, a mating array, and a self-alignment subassembly. The housing has a mounting side configured to be joined to a first circuit board and a header portion configured to move relative to the housing along a mating direction toward a second circuit board. The mating array is interconnected with the header portion and includes a terminal configured to couple with a mating terminal of the second circuit board. The mating array is configured to move in the mating direction to couple the terminal with the mating terminal of the second circuit board. The self-alignment subassembly is disposed between the mating array and the header portion. The self-alignment subassembly includes an approximately planar body with resilient bodies protruding from the spring plate. The resilient bodies apply a floating force on the mating array that permits alignment of the terminal of the mating array with the mating terminal and apply a loading force on the mating array in the mating direction that couples the terminal of the mating array with the mating terminal.

DETAILED DESCRIPTION OF THE INVENTION

Figure 1:
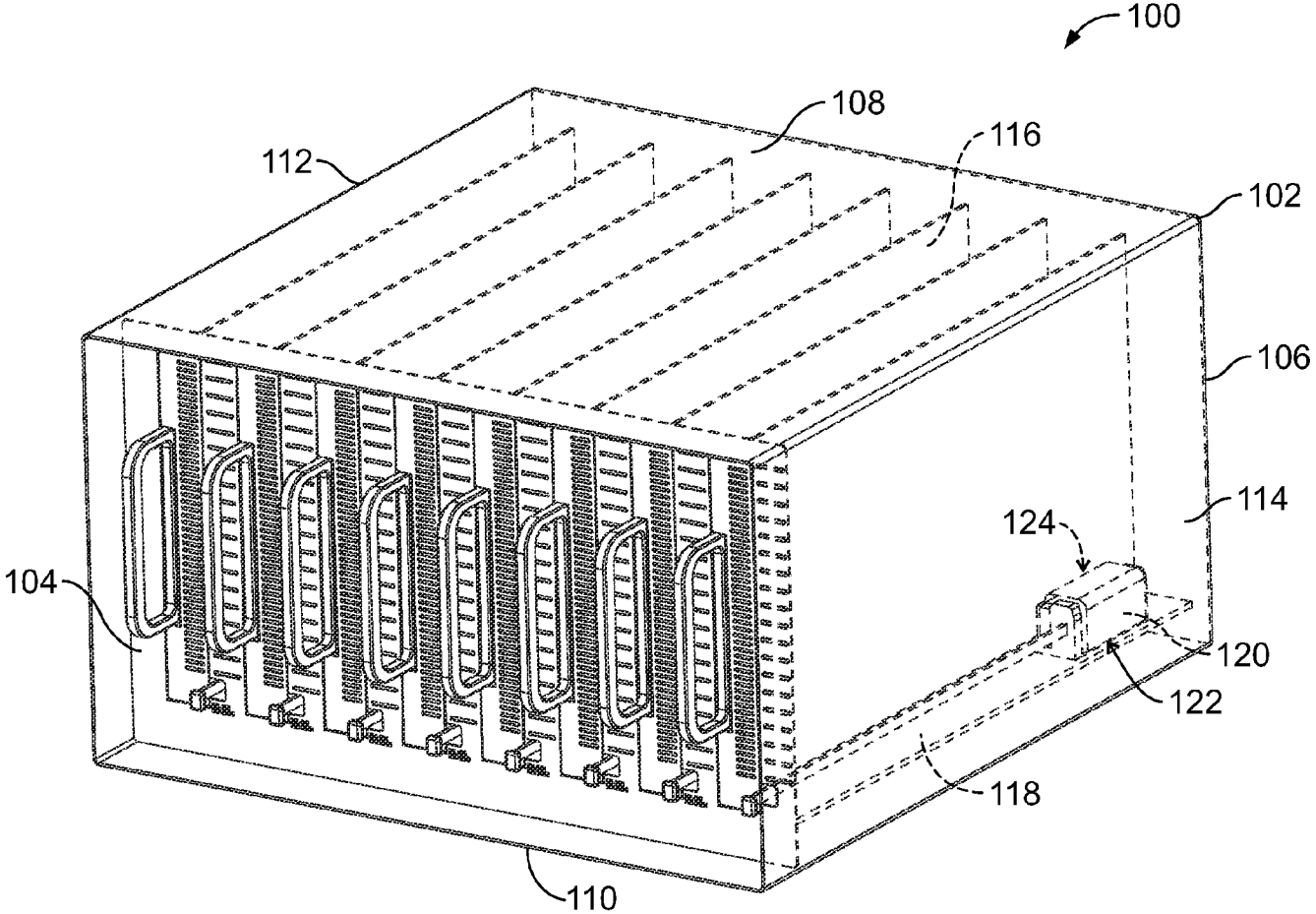
FIG. 1 is a perspective view of a circuit board system in accordance with one embodiment.

FIG. 1 is a perspective view of a circuit board system 100 in accordance with one embodiment. While the description provided herein focuses on a circuit board system that may be a server system, the embodiments described herein may be used in one or more other types of systems, such as rack-mount server systems, other non-server based systems, other connector systems that mate with circuit boards, and connector systems that mate with connectors other than circuit boards. The system 100 includes a housing 102 that has opposite front and back faces 104, 106, opposite top and bottom faces 108, 110, and opposite side faces 112, 114. The housing 102 has a shape of a right rectangular prism, or a rectangular cuboid. For example, the opposite faces 104/106, 108/110, and 112/114 of the housing 102 may be approximately equal in size and the angles between intersecting faces may be approximately perpendicular. Alternatively, the housing 102 may have a different shape.

Several removable circuit boards 116 may be loaded into and removed from the housing 102 through the front face 104. For example, the front face 104 may be open such that the removable circuit boards 116 may be inserted into and removed from the housing 102 through the front face 104. In the illustrated embodiment, the removable circuit boards 116 are blade server boards held in a parallel relationship with respect to one another within the housing 102. For example, the removable circuit boards 116 are oriented approximately parallel to one another within the housing 102. The removable circuit boards 116 are capable of being loaded into and removed from the housing 102 multiple times without damaging or otherwise deconstructing the system 100. Each of the removable circuit boards 116 may be a printed circuit board having one or more electronic components (not shown) mounted thereon. The electronic components may include, by way of example only, hard drives, power supplies, network connectors, input/output devices and connectors, integrated circuits and processors, and the like. The removable circuit boards 116 include terminals 124 disposed on or at one or more of opposite surfaces of the removable circuit boards 116.

A circuit board that may be referred to as a motherboard 118 is disposed within the housing 102 in a location proximate to the bottom face 110. For example, the motherboard 118 may be located in the housing 102 in a position that is approximately parallel to the bottom face 110 and that is closer to the bottom face 110 than the top face 108. In the illustrated embodiment, the motherboard 118 is disposed in a non-parallel relationship with respect to the removable circuit boards 116. For example, the motherboard 118 may be approximately perpendicular with respect to the removable circuit boards 116. The motherboard 118 includes terminals 122 disposed on an upper surface of the motherboard 118.

The connector assembly 120 is coupled with the motherboard 118 and may couple and decouple with one or more of the removable circuit boards 116 to alternatively couple and decouple the removable circuit boards 116 with the motherboard 118. For example, the connector assembly 120 may include terminals (not shown) that mate with the terminals 122 of the motherboard 118 to electrically couple the connector assembly 120 with the motherboard 118. As described below, the connector assembly 120 includes terminals 220 (shown in FIG. 2) that couple with the terminals 124 of the removable circuit boards 116 to electrically couple the connector assemblies 120 with the removable circuit boards 116. One or more of the terminals 122, 124, 220 may be conductive terminals for electrically communicating signals or fiber optic connections for optically communicating signals.

In one embodiment, a single connector assembly 120 may be mounted to the motherboard 118 for each of the removable circuit boards 116 that is mated to the motherboard 118. For example, each connector assembly 120 may mate with a single removable circuit board 116. Alternatively, several connector assemblies 120 may be mounted to the motherboard 118 for each of the removable circuit boards 116. For example, two or more connector assemblies 120 may mate with a removable circuit board 116. In another embodiment, a single connector assembly 120 may be mounted to the motherboard 118 for two or more of the removable circuit boards 116. For example, a single connector assembly 120 may mate with two or more removable circuit boards 116. A combination of the connector assemblies 120 may be disposed within the housing 102. By way of example only, some connector assemblies 120 may mate with a single removable circuit board 116, other connector assemblies 120 may mate with multiple removable circuit boards 116, and some groups of connector assemblies 120 may mate with a singe removable circuit board 116. Alternatively, the connector assemblies 120 may be mounted to the removable circuit boards 116 to mate with the motherboard 118.

Data signals and/or electric power may be communicated between the removable circuit boards 116 and the motherboard 118 via one or more of the connector assemblies 120. The housing 102 may permit air to flow through the housing 102 from the front face 104 to the back face 106, and vice-versa. The connector assemblies 120 may be mounted to the motherboard 118 to avoid significantly restricting the airflow through the housing 102. As shown in FIG. 1, the connector assemblies 120 comprise a relatively low height profile above the motherboard 118. For example, the connector assemblies 120 do not significantly project from the motherboard 118 such that airflow across the surface of the motherboard 118 is considerably impeded.

Figure 2:
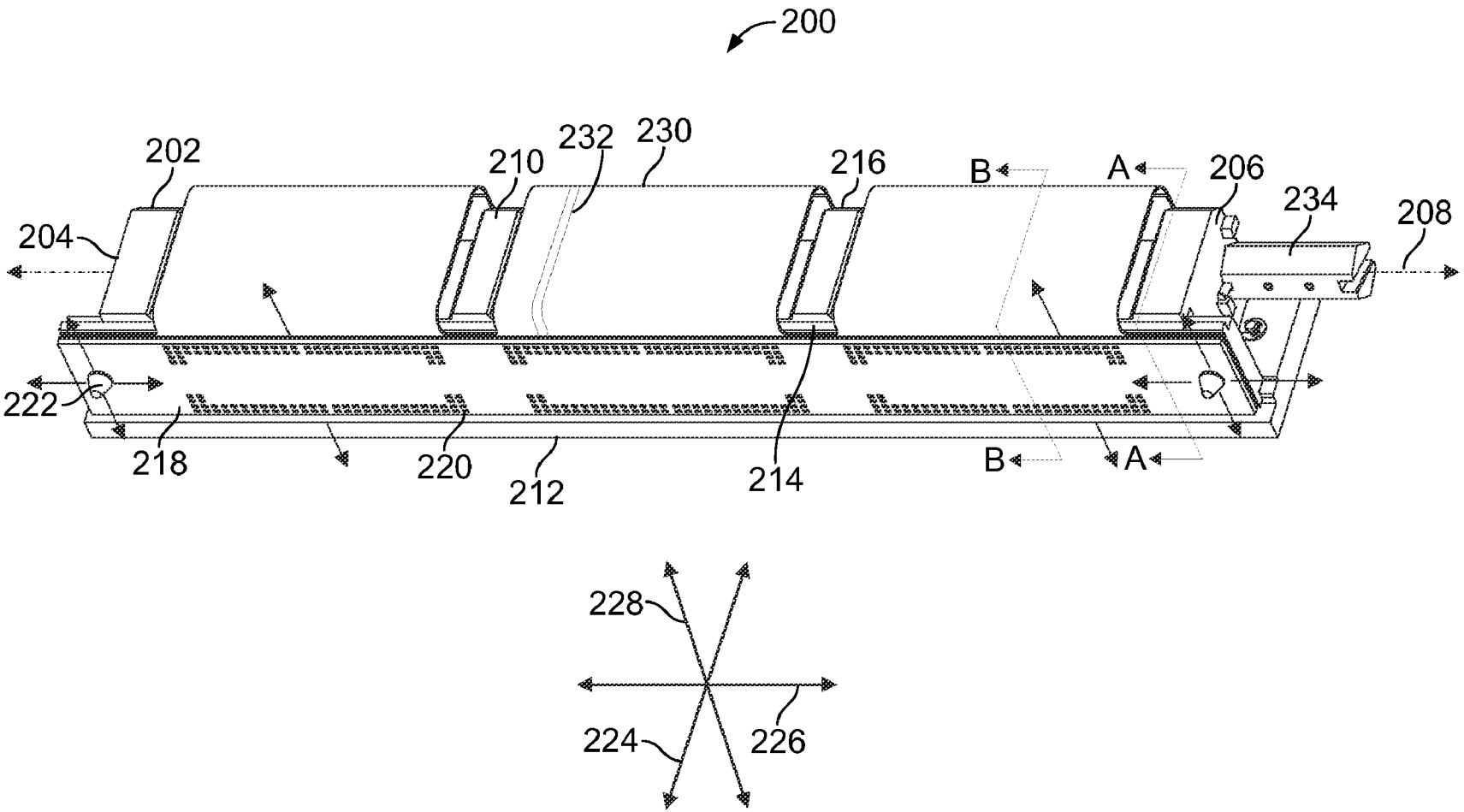
FIG. 2 is a perspective view of a connector assembly in accordance with one embodiment.

FIG. 2 is a perspective view of a connector assembly 200 in accordance with one embodiment. The connector assembly 200 may be mounted to the motherboard 118 (shown in FIG. 1) and mate with the removable circuit boards 116 (shown in FIG. 1) similar to the connector assembly 120 (shown in FIG. 1). The connector assembly 200 includes a housing 202 that is elongated between opposite sides 204, 206 along a longitudinal axis 208. The housing 202 includes a top side 210 disposed opposite of a mounting side 212, and a front side 214 oriented opposite of a back side 216. In the illustrated embodiment, the longitudinal axis 208 extends between the top side 210 and the mounting side 212, and between the front side 214 and the back side 216.

A floating mating array 218 is joined with the front side 214 of the housing 202. The mating array 218 is an approximately planar body with several terminals 220 disposed thereon. The mating array 218 moves away from the housing 202 to mate the terminals 220 with the mating terminals 124 (shown in FIG. 1) on the removable circuit board 116. As described herein, the connector assembly 200 may include one or more embodiments of a self-alignment subassembly 318, 704, 910, 1100 (shown in FIGS. 3, 7, 9, and 11) that provides a floating force that aligns the terminals 220 of the mating array 218 with the mating terminals 124 of the removable circuit board 116 and provides a loading force that couples the terminals 220 with the terminals 124. As used herein, the term "mating array" includes a plurality of terminals arranged in a predetermined configuration. For example, the mating array may be a terminal array having conductive terminals that are configured to establish an electrical connection, or the mating array may be an optical terminal array having optical terminals configured to establish an optical connection. In some embodiments, the mating array may include both mating terminals and optical terminals.

The mating array 218 includes forwardly projecting alignment pins 222. The alignment pins 222 are received into alignment openings 308 (shown in FIG. 3) in the removable circuit board 116. The alignment pins 222 are received in the alignment openings 308 to spatially align the terminals 220 of the mating array 218 with the terminals 124 of the removable circuit board 116. For example, the mating array 218 moves away from the housing 202 in a z-direction 224 to mate the mating array 218 with the removable circuit board 116. Movement of the mating array 218 in the z-direction 224 toward the removable circuit board 116 may be referred to as movement in a mating direction. The alignment pins 222 may be received in the alignment openings 308 to align the terminals 220 of the mating array 218 with the terminals 124 of the removable circuit board 116 in x- and y-directions 226, 228. The mating array 218 floats, or moves, relative to the housing 206 in the x- and y-directions 226, 228 in order to align the terminals 220 of the mating array 218 with the terminals 124 of the removable circuit board 116. The z-, x-, and y-directions 224, 226, 228 are bi-directional and oriented perpendicular to one another in the illustrated embodiment.

The mounting side 212 of the housing 202 includes terminals (not shown) that are electrically and/or optically coupled with the motherboard 118 when the connector assembly 200 is mounted to the motherboard 118. The terminals on the mounting side 212 are communicatively coupled with the terminals 220 on the mating array 218 via a circuit member 230. For example, the circuit member 230 may be a flexible circuit that extends from the front side 214 of the housing 202, across the top side 210 and the back side 216 to the mounting side 212. The circuit member 230 may include communication lines 232 such as conductive traces or optical fibers that electrically and/or optically couple the terminals 220 with the terminals on the mounting side 212.

An actuator 234 is held in the housing 202 and protrudes from the side 206 in the illustrated embodiment. The actuator 234 may be rotated to move the mating array 218 away from the housing 202. The actuator 234 may be rotated in an opposite direction to move the mating array 218 toward the housing 202.

Figure 3:
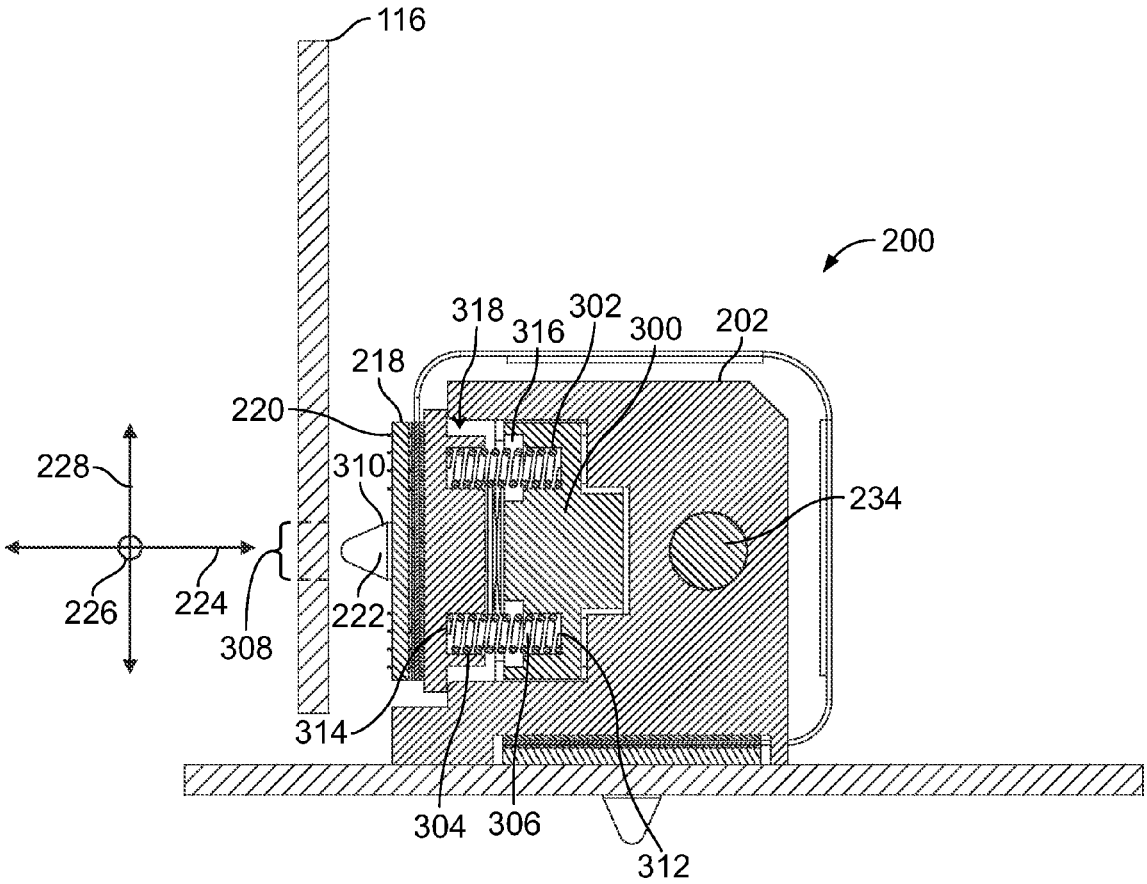
FIG. 3 is a cross-sectional view of the connector assembly shown in FIG. 2 along line A-A in FIG. 2 in an unmated state in accordance with one embodiment.

FIG. 3 is a cross-sectional view of the connector assembly 200 along line A-A in FIG. 2 in an unmated state in accordance with one embodiment. The connector assembly 200 includes a header portion 300 disposed within the housing 202. The actuator 234 is rotated to rotate a cam 412 (shown in FIG. 4) toward the header portion 300. The header portion 300 is driven by the cam 412 toward the mating array 218. The header portion 300 moves toward the mating array 218 in order to move floating and loading resilient bodies 306, 408 (shown in FIG. 4) toward the mating array 218. The header portion 300 may remain spatially separated from the mating array 218 such that the header portion 300 does not abut the mating array 218. As described below, the floating and loading resilient bodies 306, 408 allow the mating array 218 to self-align with respect to the removable circuit board 116 and mate with the removable circuit board 116.

The header portion 300 includes several bores 302 and bores 316 extending into the header portion 300 in the illustrated embodiment. The mating array 218 also includes several bores 304. Alternatively, a different number of the bores 302, 304, and/or 316 than what is shown may be provided. In the illustrated embodiment, the self-alignment subassembly 318 includes one or more resilient bodies that provide the floating force to the mating array 218 to permit alignment of the mating array 218 with the removable circuit board 116 and that provide the loading force to couple the terminals 220 of the mating array 218 with the terminals 124 (shown in FIG. 1) of the removable circuit board 116. The self-alignment subassembly 318 may include one or more floating resilient bodies 306 and/or one or more loading resilient bodies 408 (shown in FIG. 4). Although the self-alignment subassembly 318 is shown in FIG. 3 as only pointing to the floating resilient bodies 306, the self-alignment subassembly 318 may also include the loading resilient bodies 408 shown in FIG. 4.

The floating resilient bodies 306 are disposed in the bores 302, 304 and extend between the header portion 300 and the mating array 218. For example, the floating resilient bodies 306 extend between opposite ends 312, 314. The ends 312 engage the header portion 300 in the bores 302 while the ends 314 engage the mating array 218 in the bores 304. The ends 312 may engage the mating array 218 inside the bores 304. In the illustrated embodiment, the floating resilient bodies 306 are helical springs, but alternatively may be a different type of resilient member.

The floating resilient bodies 306 and corresponding bores 316 permit the mating array 218 to float, or move in one or more of the x-, y-, and z-directions 226, 228, 224, relative to the removable circuit board 116 in order to align the mating array 218 with respect to the removable circuit board 116. For example, as the mating array 218 moves toward the removable circuit board 116, the alignment pin 222 is received in the alignment opening 308 of the removable circuit board 116. The floating resilient bodies 306 may bend or flex to allow the mating array 218 to move in one or more of the x-, y-, and z-directions 226, 228, 224 in order to align itself with respect to the removable circuit board 116 in the x-, y-, and/or z-directions 226, 228, 224.

Figure 17:
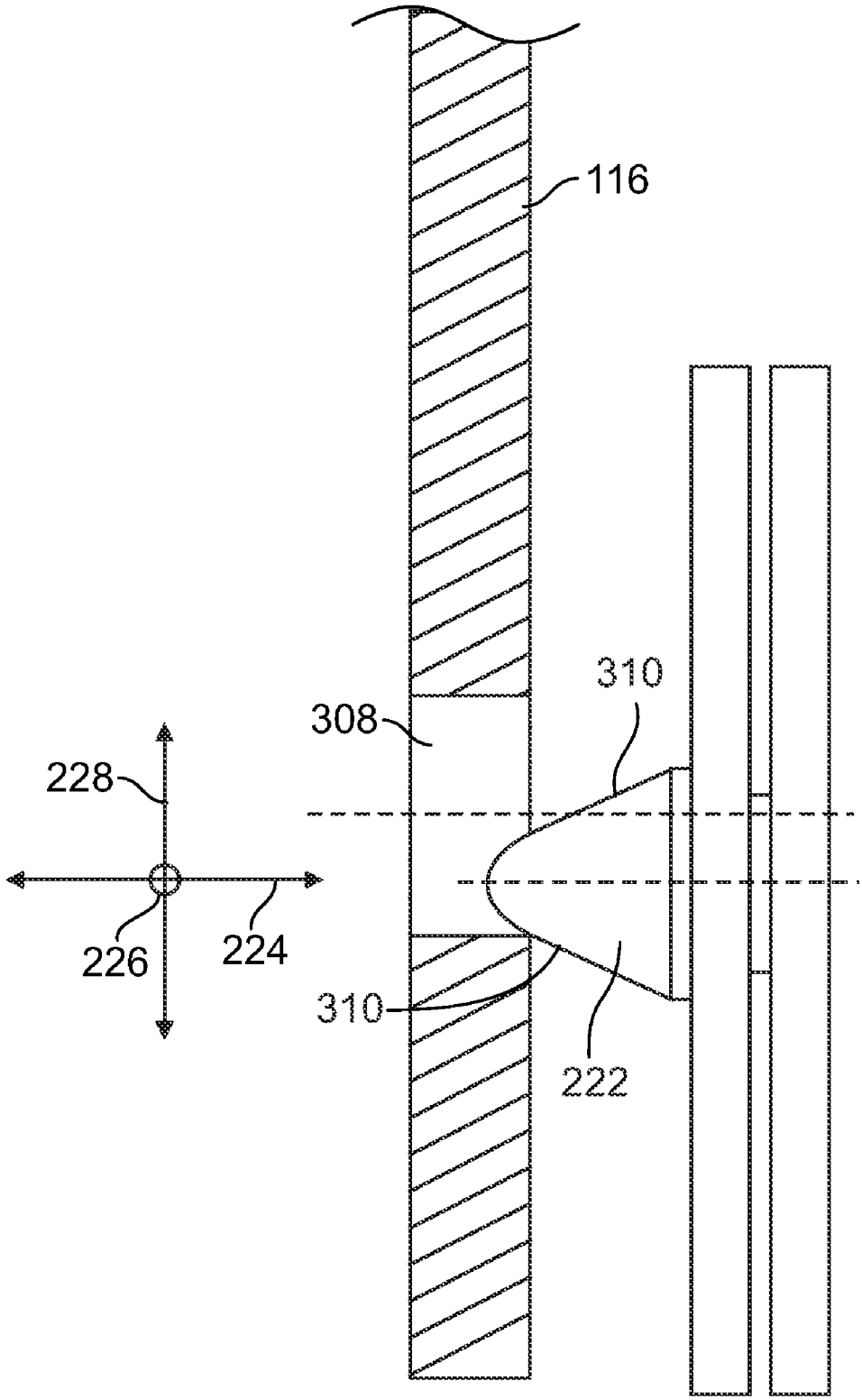
FIG. 17 is a partial view of an alignment pin shown in FIG. 2 received in an alignment opening shown in FIG. 3 of the circuit board shown in FIG. 1 in accordance with one embodiment.

FIG. 17 is a partial view of the alignment pin 222 received in the alignment opening 308 of the removable circuit board 116 in accordance with one embodiment. As shown in FIG. 17, the alignment pin 222 may be misaligned with the alignment opening 308 in one or more of the x- and y-directions 226, 228. If the alignment pin 222 is not axially centered with the alignment opening 308, then sloped exterior surfaces 310 of the alignment pin 222 may engage the removable circuit board 116 along the interior of the alignment opening 308 to move the mating array 218 along the x- and y-directions 226, 228 in order to center the alignment pin 222 in the alignment opening 308.

Returning to the discussion of FIG. 3 with continued reference to FIG. 17, the floating resilient bodies 306 may bend or flex as the mating array 218 moves toward the removable circuit board 116 in order to allow the mating array 218 to move in the x- and/or y-directions 226, 228 as the alignment pin 222 centers itself in the alignment opening 308. In one embodiment, the floating resilient bodies 306 remain in compression or tension when the mating array 218 moves toward the removable circuit board 116 and self-aligns with respect to the removable circuit board 116. The floating resilient bodies 306 allow the mating array 218 to float in the x- and y-directions 226, 228 relative to both the removable circuit board 116 and the housing 202 to ensure that the mating array 218 and the terminals 220 are aligned with the removable circuit board 116 and the terminals 124. As the alignment pin 222 is centered within the alignment opening 308, the terminals 220 on the mating array 218 are aligned with respect to the terminals 124 (shown in FIG. 1) of the removable circuit board 116.

Figure 4:
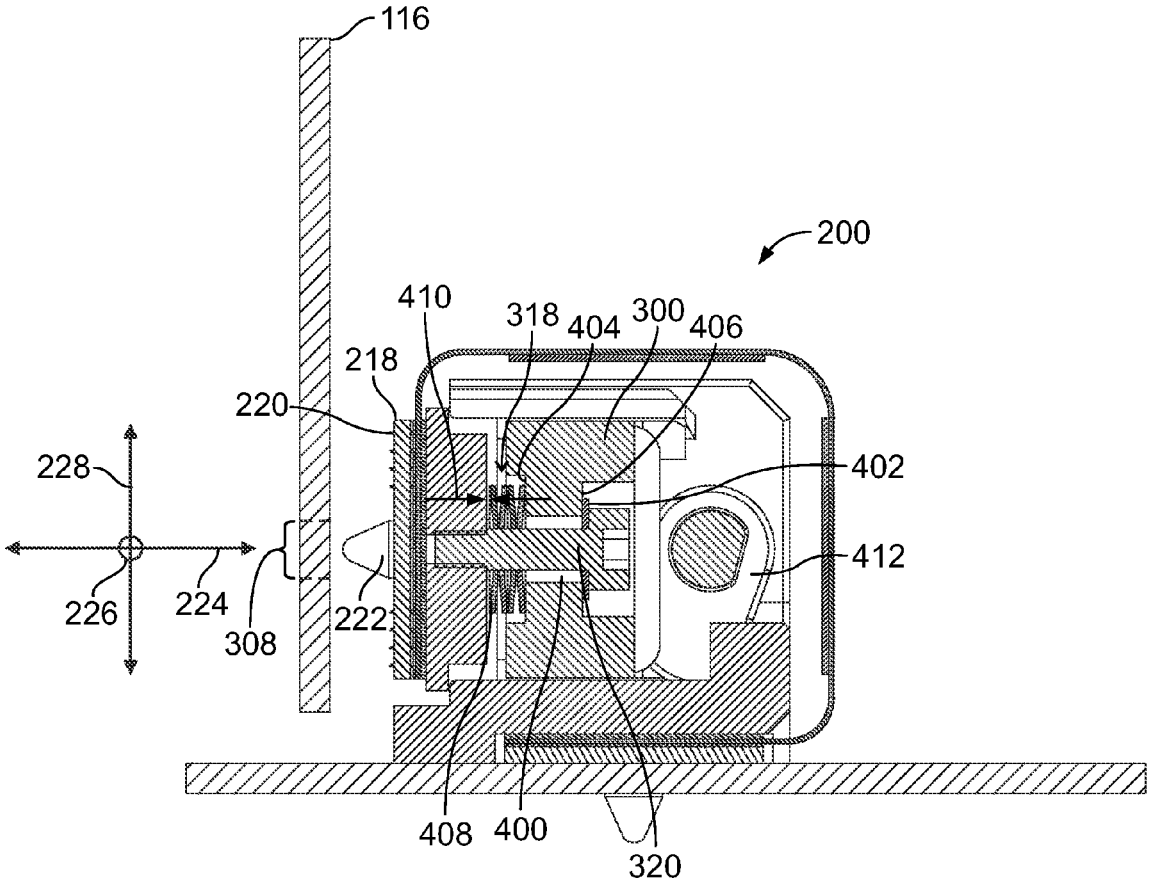
FIG. 4 is a cross-sectional view of the connector assembly shown in FIG. 2 along line B-B in FIG. 2 in an unmated state in accordance with one embodiment.

FIG. 4 is a cross-sectional view of the connector assembly 200 along line B-B in FIG. 2 in an unmated state in accordance with one embodiment. The alignment pin 222 extends through the mating array 218. The mating array 218 may be coupled to the alignment pin 222 such that movement of the alignment pin 222 in the x-, y-, and/or z-directions 226, 228, 224 also moves the mating array 218. The mating array 218 and the header portion 300 may be coupled by an elongated member 320, such as a shoulder screw. The elongated member 320 may be coupled with the alignment pin 222 or separate from the alignment pin 222. The header portion 300 includes a channel 400 that extends through the header portion 300 between opposite ends 404, 406. The elongated member 320 extends through the channel 400. As shown, the channel 400 may be sufficiently large to permit the elongated member 320 to move in the x- and/or y-directions 226, 228 relative to the header portion 300 and also without moving the header portion 300. The elongated member 320 includes a flange 402 that engages one end 406 of the header portion 300.

The loading resilient bodies 408 of the self-alignment subassembly 318 are disposed between the mating array 218 and the header portion 300. In the illustrated embodiment, the floating and loading resilient bodies 306 (shown in FIG. 3), 408 of the self-alignment subassembly 318 are separate and spaced apart from each other. When the mating array 218 is unmated or separated from the removable circuit board 116, a gap 410 may exist between the loading resilient bodies 408 and the mating array 218. Alternatively, the loading resilient bodies 408 may abut the mating array 218 such that no gap 410 is provided. In the illustrated embodiment, the loading resilient bodies 408 are several conical or spring washers, such as Belleville™ washers stacked on one another and encircling the elongated member 320 between the mating array 218 and the header portion 300. A conical or spring washer may be a washer that has a non-planar shape and that imparts a force when compressed. The loading resilient bodies 408 are shown in an uncompressed state in FIG. 4. Alternatively, resilient members other than Belleville™ washers may be used as the loading resilient bodies 408. Once the alignment pin 222 is received in the alignment opening 308 of the removable circuit board 116, the loading resilient bodies 408 may be compressed between the mating array 218 and the header portion 300.

Compression of the loading resilient bodies 408 causes the loading resilient bodies 408 to apply a loading force on the mating array 218 along the z-direction 224 toward the removable circuit board 116. As described above, the floating resilient bodies 306 (shown in FIG. 3) bend or flex to apply a resilience, or a floating force, on the mating array 218 that permits the mating array 218 to self-align with respect to the removable circuit board 116. For example, the floating force may be a force that is imparted on the mating array 218 in one or more directions along or parallel to a plane defined by the x- and y-directions 226, 228. The floating force permits movement of the mating array 218 in the x- and y-directions 226, 228 and may permit movement of the mating array 218 in the z-direction 224 such that the terminals 220 of the mating array 218 are aligned with the terminals 124 (shown in FIG. 1) of the removable circuit board 116.

The loading force applied by the loading resilient bodies 408 is a force that is at least as great as a mating force that is required to compress or mate the terminals 220 of the mating array 218 with the terminals 124 (shown in FIG. 1) of the removable circuit board 116. For example, the loading force causes the mating array 218 to couple with the removable circuit board 116 such that the mating array 218 and removable circuit board 116 are mated and communicatively coupled. The loading resilient bodies 408 may remain in compression when the mating array 218 is coupled with the removable circuit board 116 such that the loading resilient bodies 408 provide tolerance soak up, or increased tolerance, in the spacing between the mating array 218 and the removable circuit board 116 along the z-direction 224. Additionally, the loading resilient bodies 408 may remain in compression when the mating array 218 is coupled with the removable circuit board 116 such that the loading resilient bodies 408 permit the mating array 218 to mate with a removable circuit board 116 that is not coplanar with the mating array 218.

Figure 5:
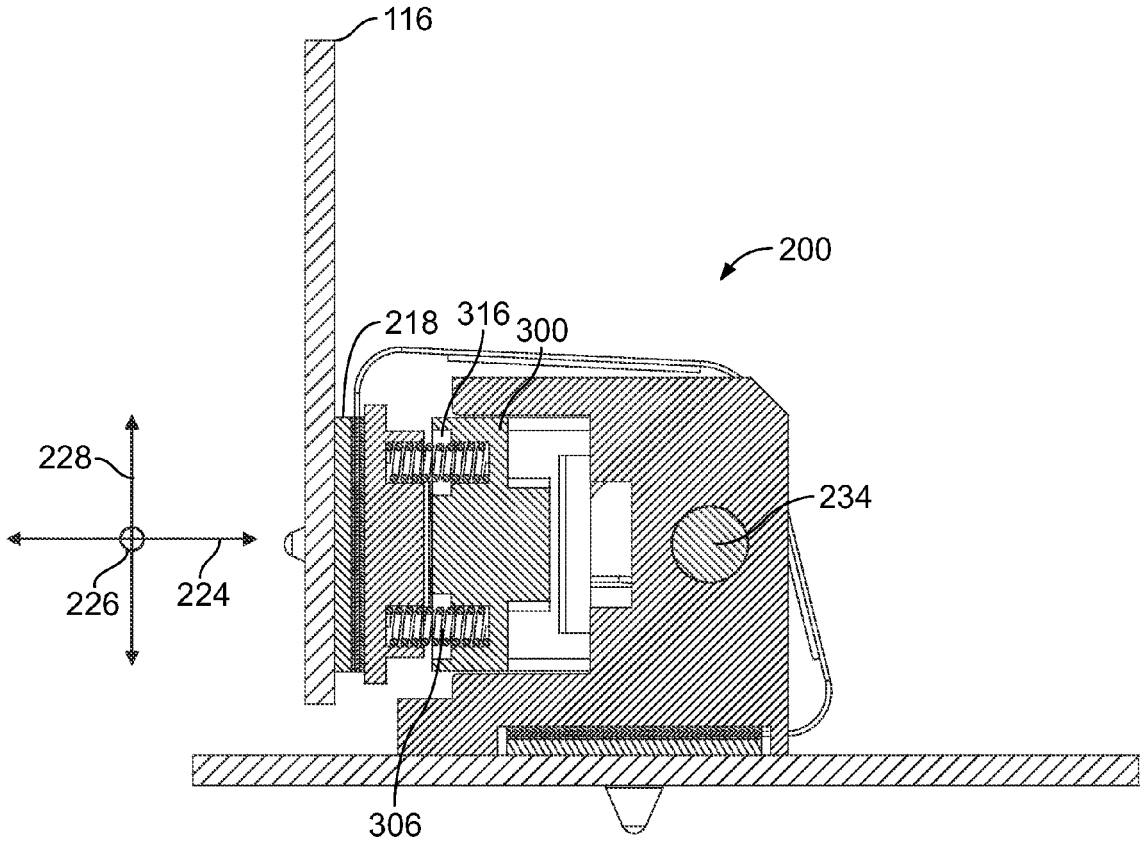
FIG. 5 is a cross-sectional view of the connector assembly shown in FIG. 2 in a mated state along line A-A in FIG. 2 in accordance with one embodiment.

FIG. 5 is a cross-sectional view of the connector assembly 200 in a mated state along line A-A in FIG. 2 in accordance with one embodiment. FIG. 5 shows the mating array 218 coupled with the removable circuit board 116. As described above, the header portion 300 and the mating array 218 are driven in the z-direction 224 toward the removable circuit board 116 by the actuator 234 and cam 412 (shown in FIG. 4). The floating resilient bodies 306 permit the mating array 218 to move along the x- and/or y-directions 226, 228 until the mating array 218 engages the removable circuit board 116. The floating resilient bodies 306 may be less than fully compressed when the mating array 218 engages the removable circuit board 116. For example, the floating resilient bodies 306 may be capable of being compressed further between the mating array 218 and the header portion 300 when the mating array 218 engages and mates with the removable circuit board 116 in order to provide increased tolerance in the spacing and/or alignment between the mating array 218 and the removable circuit board 116.

Figure 6:
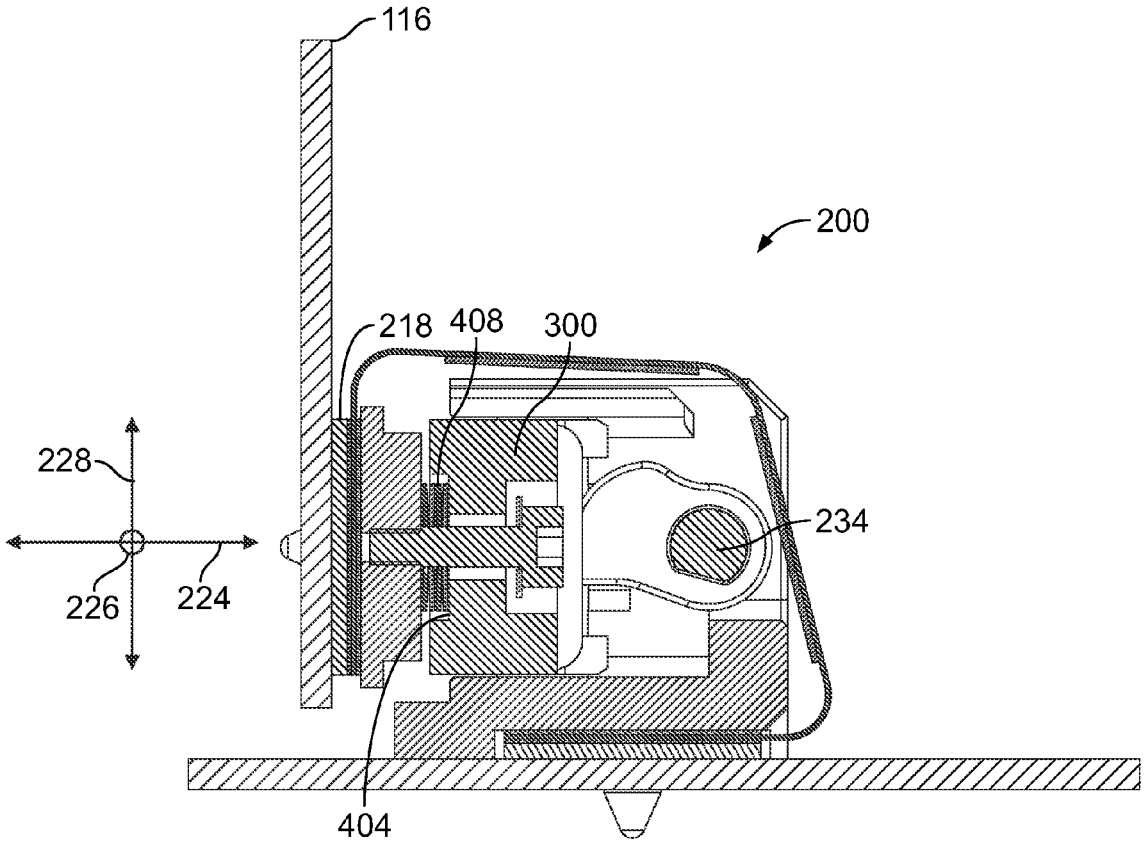
FIG. 6 is a cross-sectional view of the connector assembly shown in FIG. 2 in the mated state along line B-B in FIG. 2 in accordance with one embodiment.

FIG. 6 is a cross-sectional view of the connector assembly 200 in the mated state along line B-B in FIG. 2 in accordance with one embodiment. The loading resilient bodies 408 are shown in a compressed state. Once the floating resilient bodies 306 (shown in FIG. 3) permit the mating array 218 to become self-aligned with and engage the removable circuit board 116, further movement of the header portion 300 in the z-direction 224 toward the removable circuit board 116 compresses the loading resilient bodies 408. For example, the actuator 234 may be rotated to continue driving the header portion 300 in the z-direction 224 after the mating array 218 has engaged the removable circuit board 116.

As the header portion 300 continues to move in the z-direction 224, the header portion 300 pushes the loading resilient bodies 408 forward to close the gap 410 (shown in FIG. 4) and engage the mating array 218. The loading resilient bodies 408 are compressed between the mating array 218 and the end 404 of the header portion 300. The loading resilient bodies 408 are compressed and impart a loading force on the mating array 218 in the z-direction 224. The loading force mates the terminals 220 (shown in FIG. 2) of the mating array 218 with the terminals 124 (shown in FIG. 1) of the removable circuit board 116. For example, the loading resilient bodies 408 may impart the loading force on the mating array 218 in the z-direction 224 toward the removable circuit board 116 that overcomes or is greater than mating forces that are required to mate the terminals 220 with the terminals 124. As shown in FIG. 6, the loading resilient bodies 408 may be less than fully compressed when the mating array 218 is coupled with the removable circuit board 116. For example, the loading resilient bodies 408 may be capable of further compression in order to provide increased tolerances in the spacing and alignment of the mating array 218 and the removable circuit board 116.

Figure 7:
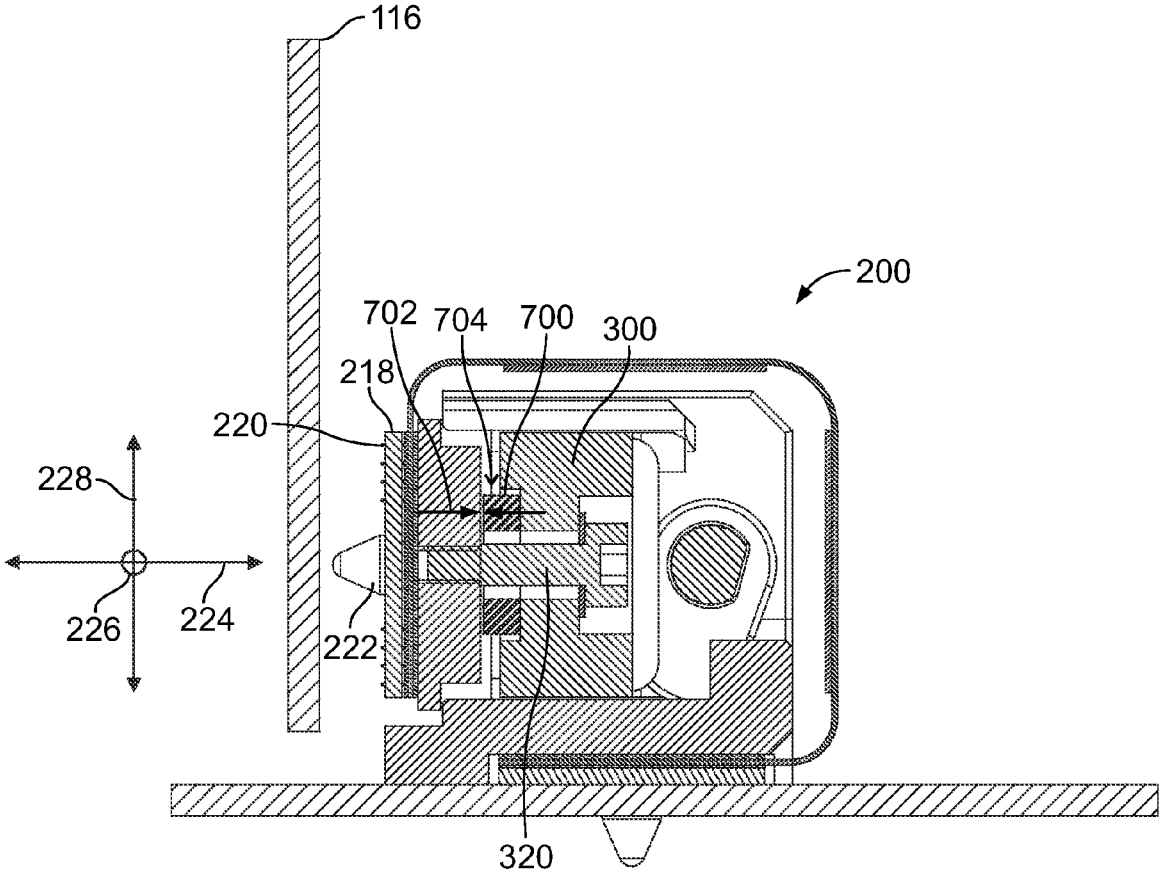
FIG. 7 is a cross-sectional view of the connector assembly shown in FIG. 2 along line B-B in FIG. 2 in an unmated state in accordance with another embodiment.
Figure 8:
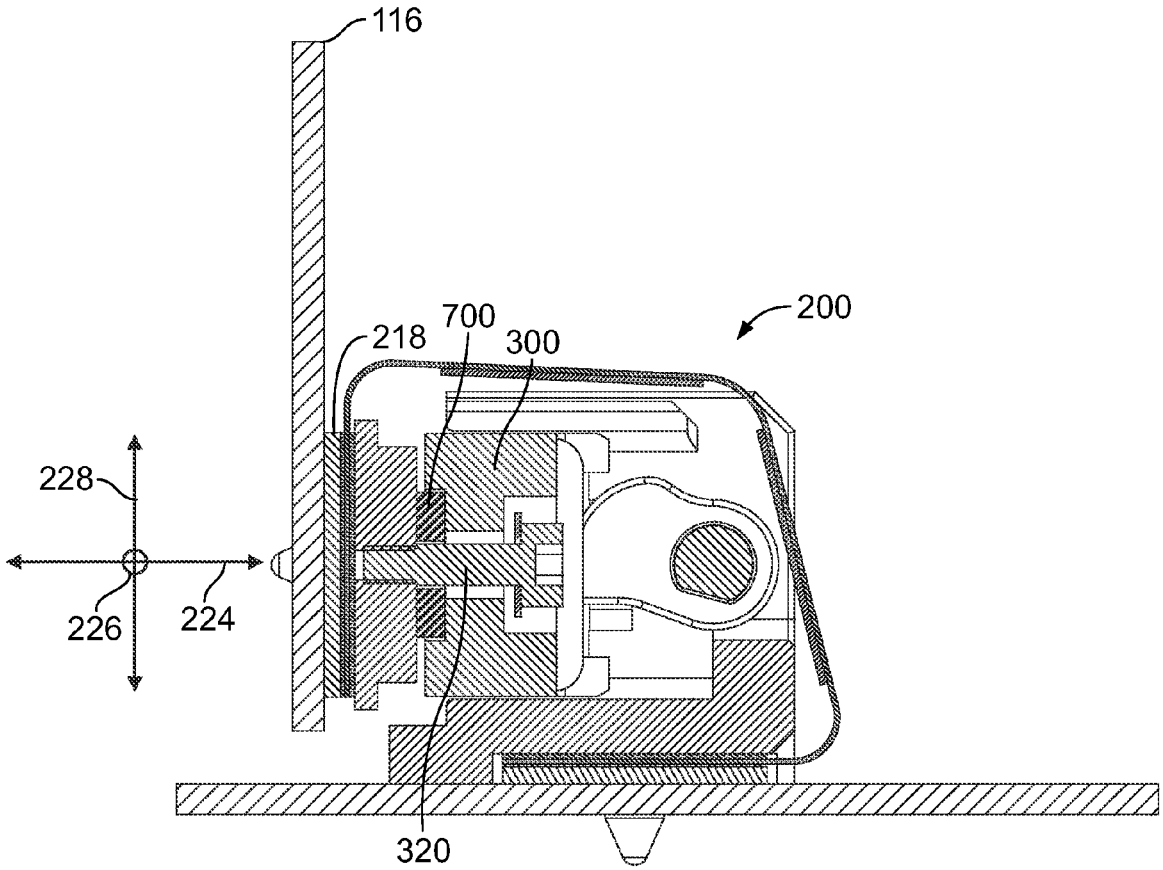
FIG. 8 is a cross-sectional view of the connector assembly shown in FIG. 7 along line B-B in FIG. 2 in a mated state.

FIG. 7 is a cross-sectional view of the connector assembly 200 along line B-B in FIG. 2 in an unmated state in accordance with another embodiment. FIG. 8 is a cross-sectional view of the connector assembly 200 shown in FIG. 7 along line B-B in FIG. 2 in a mated state. The connector assembly 200 shown in FIGS. 7 and 8 includes the self-alignment subassembly 704. The self-alignment subassembly 704 includes one or more resilient bodies that provide the floating force to the mating array 218 to align the mating array 218 with the removable circuit board 116 and that provide the loading force to couple the terminals 220 of the mating array 218 with the terminals 124 (shown in FIG. 1) of the removable circuit board 116. The self-alignment subassembly 704 may include one or more of the floating resilient bodies 306 (shown in FIG. 3) and/or one or more loading resilient bodies 700. Although the self-alignment subassembly 704 is shown in FIG. 7 as only pointing to the loading resilient bodies 700, the self-alignment subassembly 704 may also include the floating resilient bodies 306 shown in FIG. 3. In the illustrated embodiment, the self-alignment assembly 704 includes a polymeric loading resilient body 700 instead of the loading resilient bodies 408 (shown in FIG. 4) that are included in the self-alignment assembly 318 (shown in FIG. 3).

The loading resilient body 700 may include, or be formed from, one or more materials that are resilient when compressed. The loading resilient body 700 is provided between the header portion 300 and the mating array 218 similar to the loading resilient bodies 408 (shown in FIG. 4). In one embodiment, the loading resilient body 700 may be a single body that encircles the elongated member 320 between the mating array 218 and the header portion 300. The loading resilient body 700 may be separated from the mating array 218 by a gap 702 when the mating array 218 is unmated or separated from the removable circuit board 116. Alternatively, the loading resilient body 700 may abut the mating array 218 such that no gap 702 is provided.

Similar to the loading resilient bodies 408 (shown in FIG. 4), the loading resilient body 700 may remain uncompressed while the alignment pin 222 engages the removable circuit board 116 and the floating resilient bodies 306 (shown in FIG. 3) permit the mating array 218 to float in the x- and y-directions 226, 228 relative to the removable circuit board 116. Once the mating array 218 engages the removable circuit board 116, the loading resilient body 700 may be moved forward by the header portion 300 to close the gap 702 and engage the mating array 218. The loading resilient body 700 may then be compressed between the header portion 300 and the mating array 218. Depending on Poisson's ratio for the material(s) used in the loading resilient body 700, the compression of the loading resilient body 700 may cause the loading resilient body 700 to spread out and become wider, as shown in FIG. 8. The loading resilient body 700 imparts a loading force in the z-direction 224 toward the removable circuit board 116 on the mating array 218 when the loading resilient body 700 is compressed. Similar to the loading resilient bodies 408, the loading force provides a normal mating force to the mating array 218 in order to mate the terminals 220 (shown in FIG. 2) with the terminals 124 (shown in FIG. 1) of the removable circuit board 116.

Figure 9A:
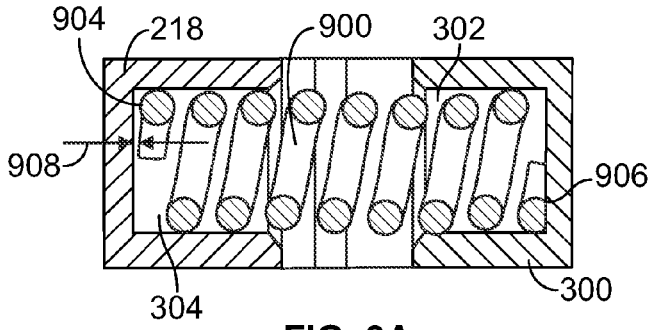
FIG. 9A is a detailed view of the connector assembly shown in FIG. 9.
Figure 9:
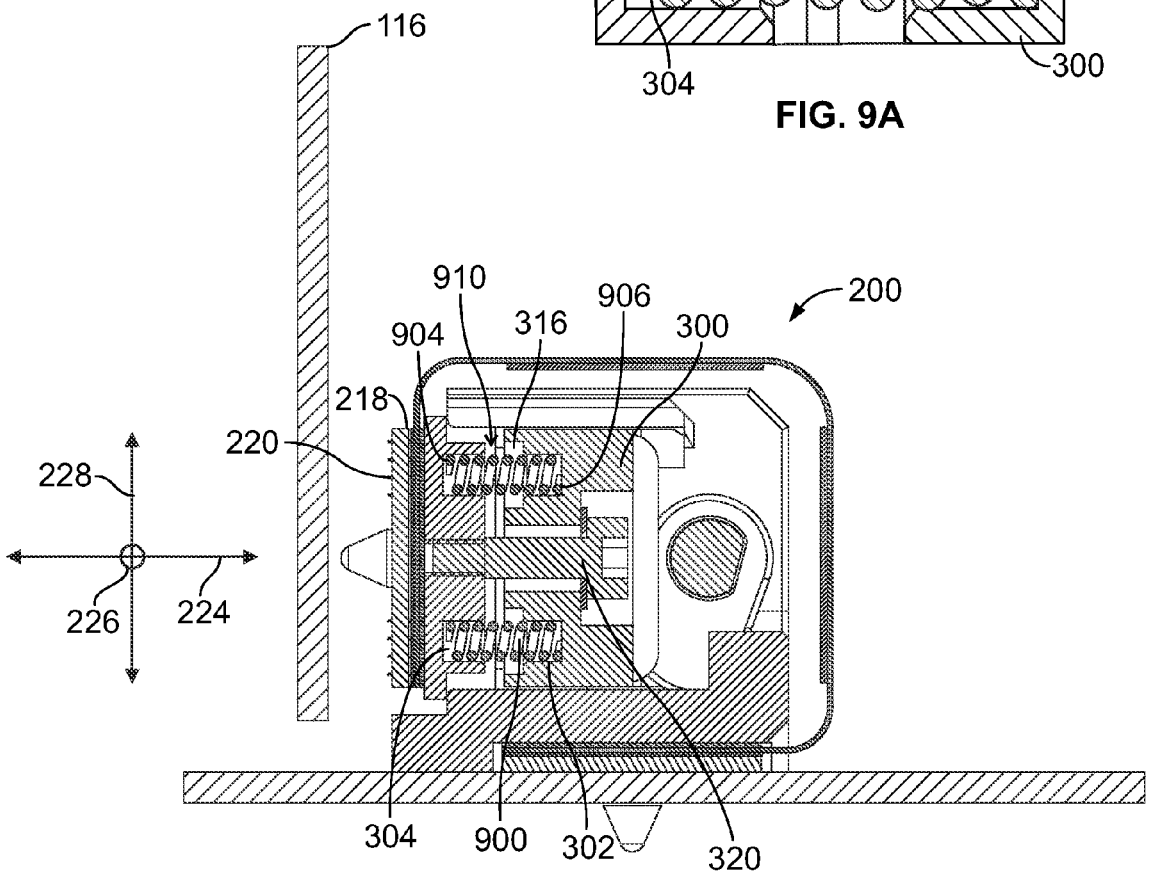
FIG. 9 is a cross-sectional view of the connector assembly shown in FIG. 2 along line B-B in FIG. 2 in an unmated state in accordance with another embodiment.
Figure 10A:
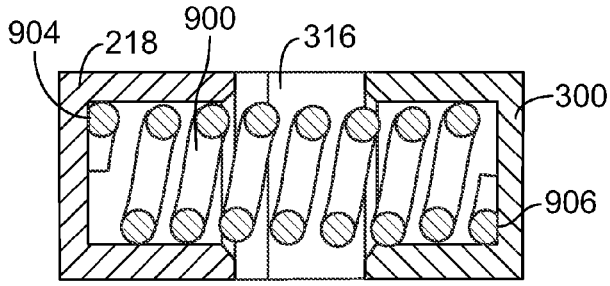
FIG. 10A is a detailed view of the connector assembly shown in FIG. 10.
Figure 10:
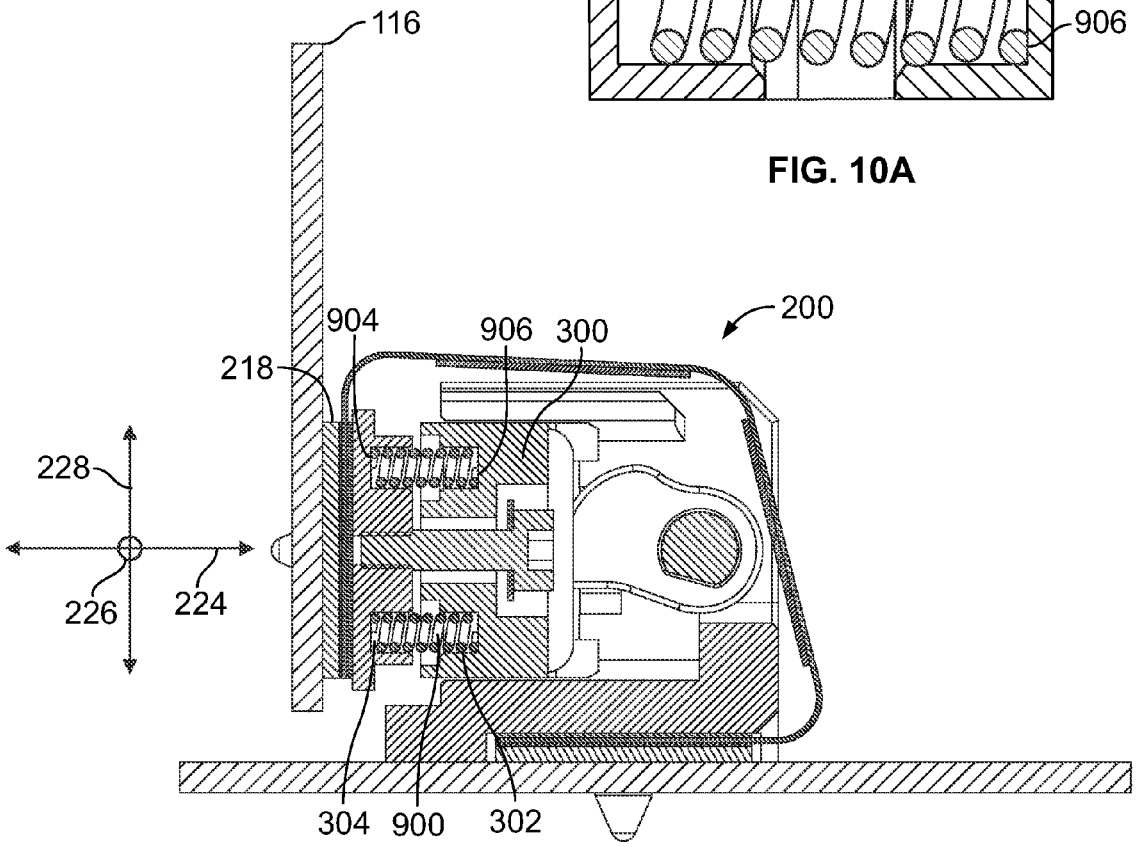
FIG. 10 is a cross-sectional view of the connector assembly shown in FIG. 9 along line B-B in FIG. 2 in a mated state.

FIG. 9 is a cross-sectional view of the connector assembly 200 along line B-B in FIG. 2 in an unmated state in accordance with another embodiment. FIG. 9A is a detailed view of the connector assembly 200 shown in FIG. 9. FIG. 10 is a cross-sectional view of the connector assembly 200 shown in FIG. 9 along line B-B in FIG. 2 in a mated state. FIG. 10A is a detailed view of the connector assembly 200 shown in FIG. 10. In the illustrated embodiment, the connector assembly 200 includes the self-alignment subassembly 910. The self-alignment subassembly 910 includes one or more resilient bodies that provide the floating force to the mating array 218 to align the mating array 218 with the removable circuit board 116 and that provide the loading force to couple the terminals 220 of the mating array 218 with the terminals 124 (shown in FIG. 1) of the removable circuit board 116. The self-alignment subassembly 910 may include one or more of the floating resilient bodies 306 (shown in FIG. 3) and/or one or more loading resilient bodies 900. Although the self-alignment subassembly 910 is shown in FIG. 9 as only pointing to the loading resilient bodies 900, the self-alignment subassembly 910 may also include the floating resilient bodies 306 shown in FIG. 3.

The loading resilient bodies 900 are illustrated as helical springs, but alternatively may be a different resilient body. The loading resilient bodies 900 extend between opposite ends 904, 906. As shown in FIG. 9A, the ends 906 of the loading resilient bodies 900 engage the header portion 300 in the bores 302 while the ends 904 are separated from the mating array 218 by a gap 908. For example, the ends 904 are located in the bores 304 of the mating array 218 but are spaced apart from the mating array 218 by the gap 908. Alternatively, the loading resilient bodies 900 may abut the mating array 218 such that no gap 908 is provided. As described above in connection with FIG. 3, the floating resilient bodies 306 of the connector assembly 200 extend between opposite ends 312, 314 that engage both the header portion 300 and the mating array 218.

The header portion 300 and the mating array 218 are moved in the z-direction 224 toward the removable circuit board 116 to engage the removable circuit board 116. The header portion 300 and the mating array 218 continue to move in the z-direction 224 toward the removable circuit board 116 until the mating array 218 engages the removable circuit board 116. As described above, the floating resilient bodies 306 permit the mating array 218 to move in the x- and y-directions 226, 228 in order to align the terminals 220 (shown in FIG. 2) of the mating array 218 with the terminals 124 (shown in FIG. 1) of the removable circuit board 116. The gap 908 between the ends 904 of the loading resilient bodies 900 and the mating array 218 permit the header portion 300 to continue to be moved in the z-direction 224 after the mating array 218 has engaged the removable circuit board 116 for a distance equal to the gap 908 until the ends 904 of the loading resilient bodies 900 engage the mating array 218.

Once the ends 904 of the loading resilient bodies 900 engage the mating array 218, continued movement of the header portion 300 in the z-direction 224 causes the loading resilient bodies 900 to be compressed between the header portion 300 and the mating array 218. As shown in FIG. 10A, the ends 904 engage the mating array 218 and the ends 906 engage the header portion 300. The compression of the loading resilient bodies 900 between the header portion 300 and the mating array 218 causes the loading resilient bodies 900 to impart a loading force on the mating array 218 in the z-direction 224 toward the removable circuit board 116. The loading force provides a normal mating force to the mating array 218 to mate the terminals 220 (shown in FIG. 2) of the mating array 218 with the terminals 124 (shown in FIG. 1) of the removable circuit board 116.

The loading resilient bodies 900 may be less than fully compressed when the mating array 218 engages the removable circuit board 116. For example, the loading resilient bodies 900 may be capable of being compressed further between the mating array 218 and the header portion 300 when the mating array 218 engages and mates with the removable circuit board 116 in order to provide increased tolerance in the spacing and/or alignment between the mating array 218 and the removable circuit board 116 along the z-direction 224.

Figure 11:
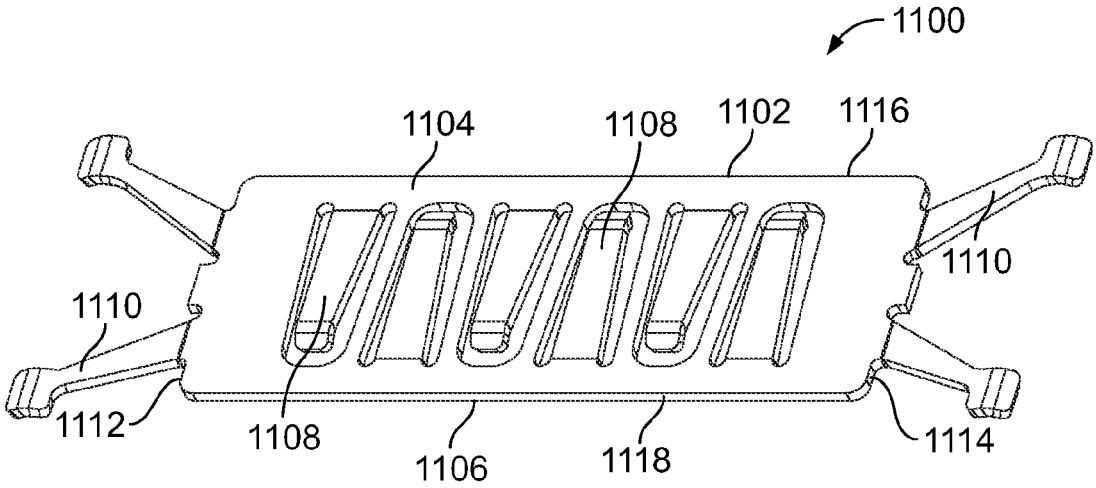
FIG. 11 is a perspective view of a spring plate in accordance with another embodiment.
Figure 12:
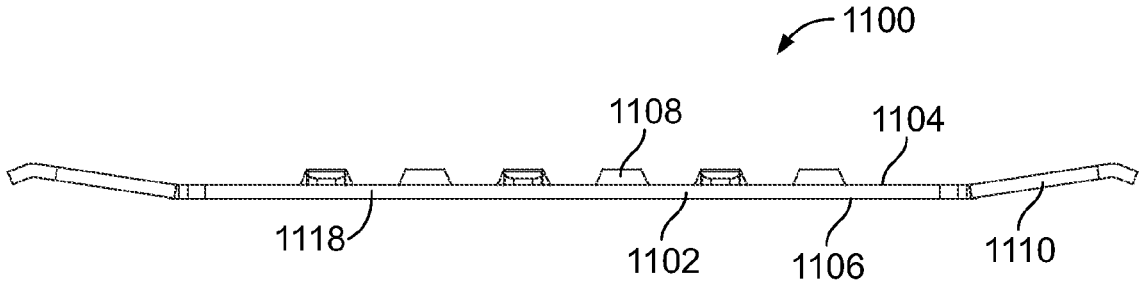
FIG. 12 is an elevational view of the spring plate shown in FIG. 11.

FIG. 11 is a perspective view of a self-aligning subassembly 1100 in accordance with one embodiment. FIG. 12 is an elevational view of the self-aligning subassembly 1100 shown in FIG. 11. The self-aligning subassembly 1100 is illustrated as a spring plate that has a generally planar body 1102 that extends between opposite sides 1104, 1106. The sides 1104, 1106 are interconnected by opposite edges 1112, 1114 and opposite edges 1116, 1118. The body 1102 includes internal loading resilient members 1108 that project from the side 1104. Alternatively, the loading resilient bodies 1108 may project from both sides 1104, 1106 of the plate 1100. The body 1102 includes external floating resilient bodies 1110 that project from the edges 1112, 1114. As shown in FIG. 11, the loading and floating resilient bodies 1108, 1110 may be cantilevered beams. Alternatively, the loading and/or floating resilient bodies 1108, 1110 may be beams that are joined to the body 1102 at both ends of the beams and that bow or arc outward from the body 1102. The floating resilient bodies 1110 may protrude farther from the side 1104 of the plate 1100 in a direction that is perpendicular to the side 1104 than the loading resilient bodies 1108 in one embodiment. The self-aligning subassembly 1100 may be a unitary body. For example, the self-aligning subassembly 1100 may be stamped and formed from a common sheet of material, such as a metal sheet. Alternatively, the self-aligning subassembly 1100 may be separately formed from multiple components that are later combined.

Figure 13:
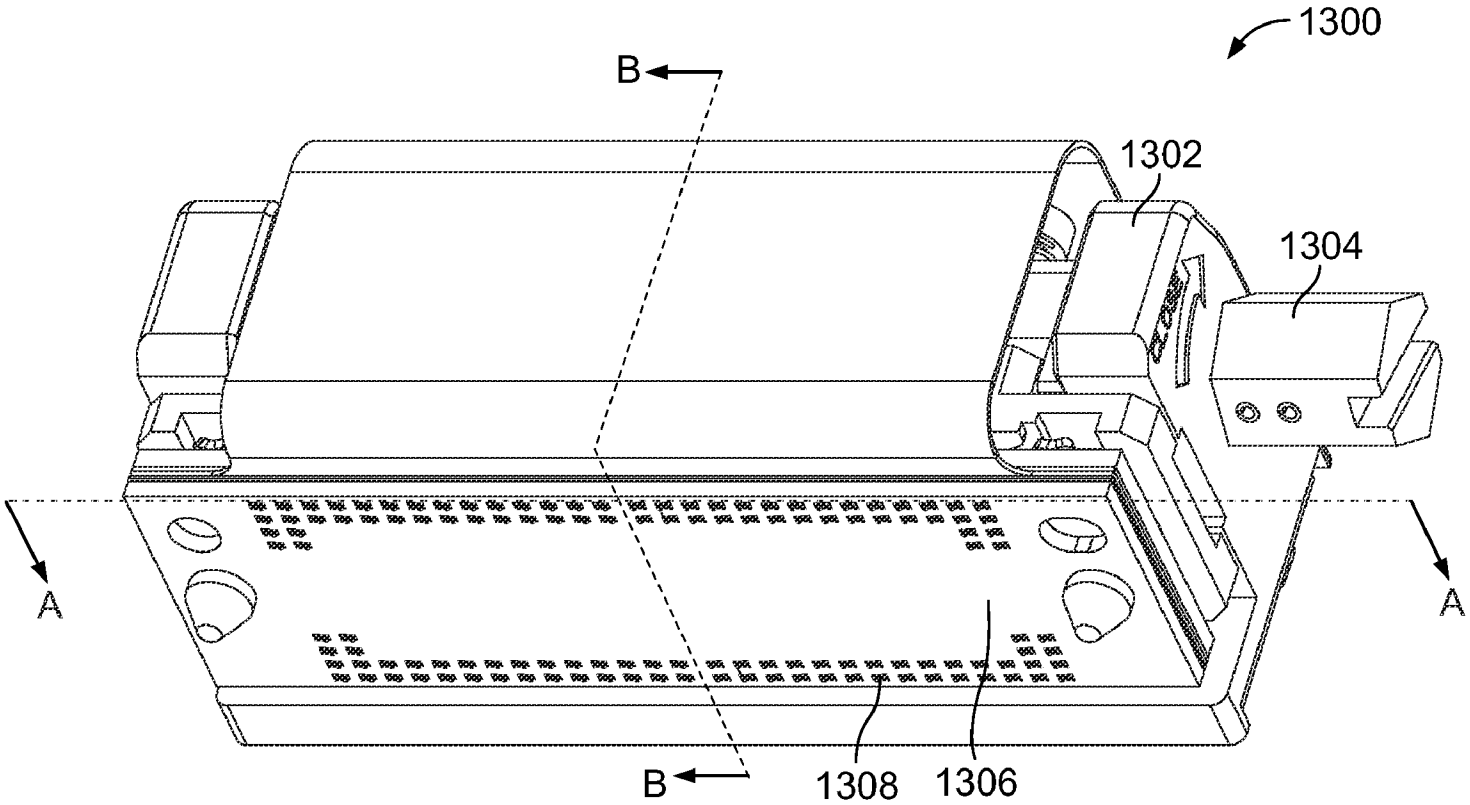
FIG. 13 is a perspective view of a connector assembly that includes the spring plate shown in FIG. 11 in accordance with one embodiment.

FIG. 13 is a perspective view of a connector assembly 1300 that includes the self-aligning subassembly 1100 shown in FIG. 11 in accordance with one embodiment. The connector assembly 1300 may be similar to the connector assembly 120 (shown in FIG. 1). For example, the connector assembly 1300 may be mounted to the motherboard 118 (shown in FIG. 1) to mate with and communicatively couple the removable circuit board 116 (shown in FIG. 1) with the motherboard 118. The connector assembly 1300 includes a housing 1302 having an actuator 1304 extending therethrough. A moveable mating array 1306 is joined to the housing 1302 and includes several terminals 1308. The actuator 1304 is rotated to move the mating array 1306 away from the housing 1302 so the terminals 1308 can mate with the terminals 124 (shown in FIG. 1) of the removable circuit board 116.

Figure 14:
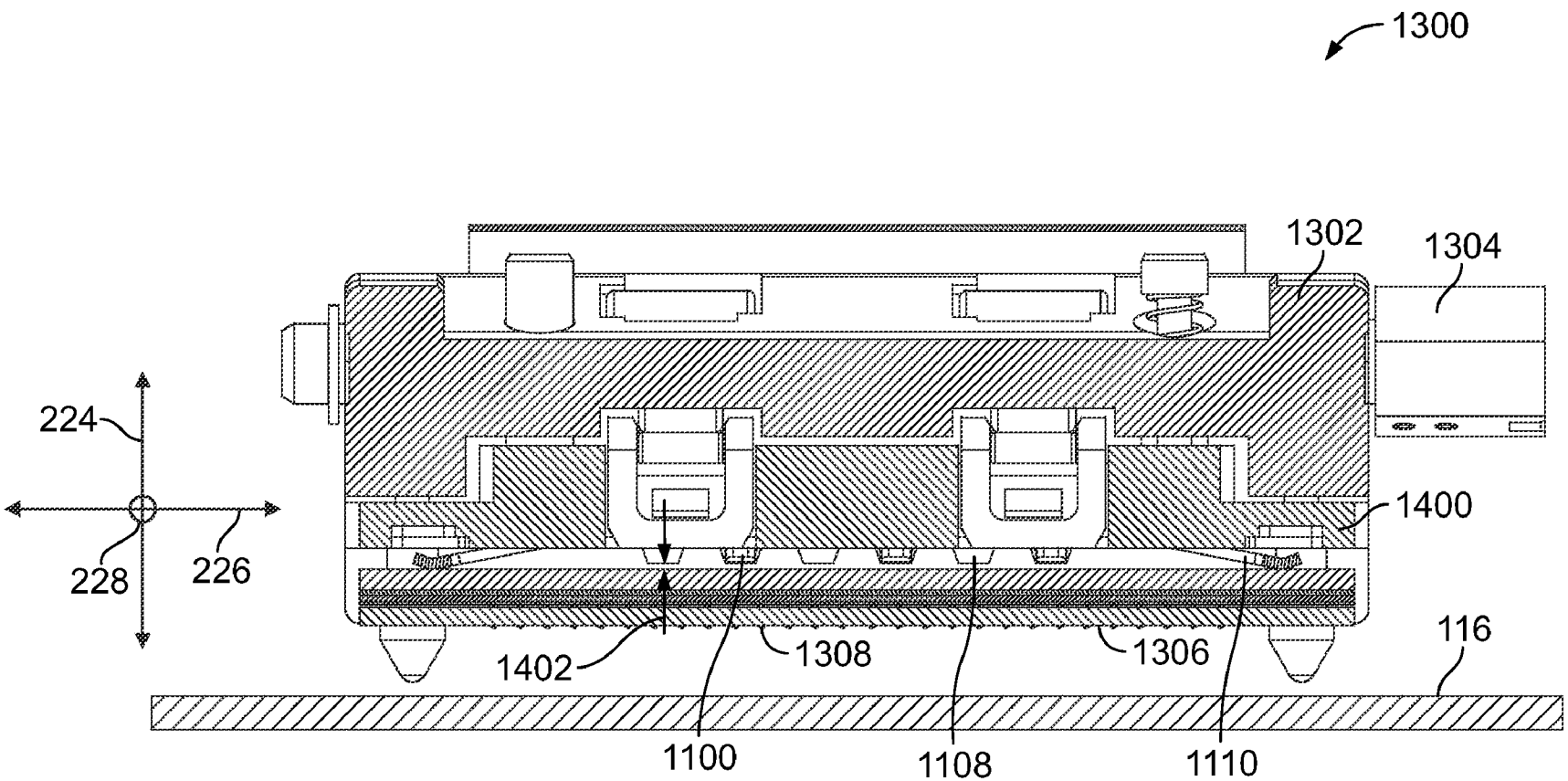
FIG. 14 is a cross-sectional view of the connector assembly shown in FIG. 13 along line A-A in FIG. 13 in an unmated state in accordance with one embodiment.
Figure 15:
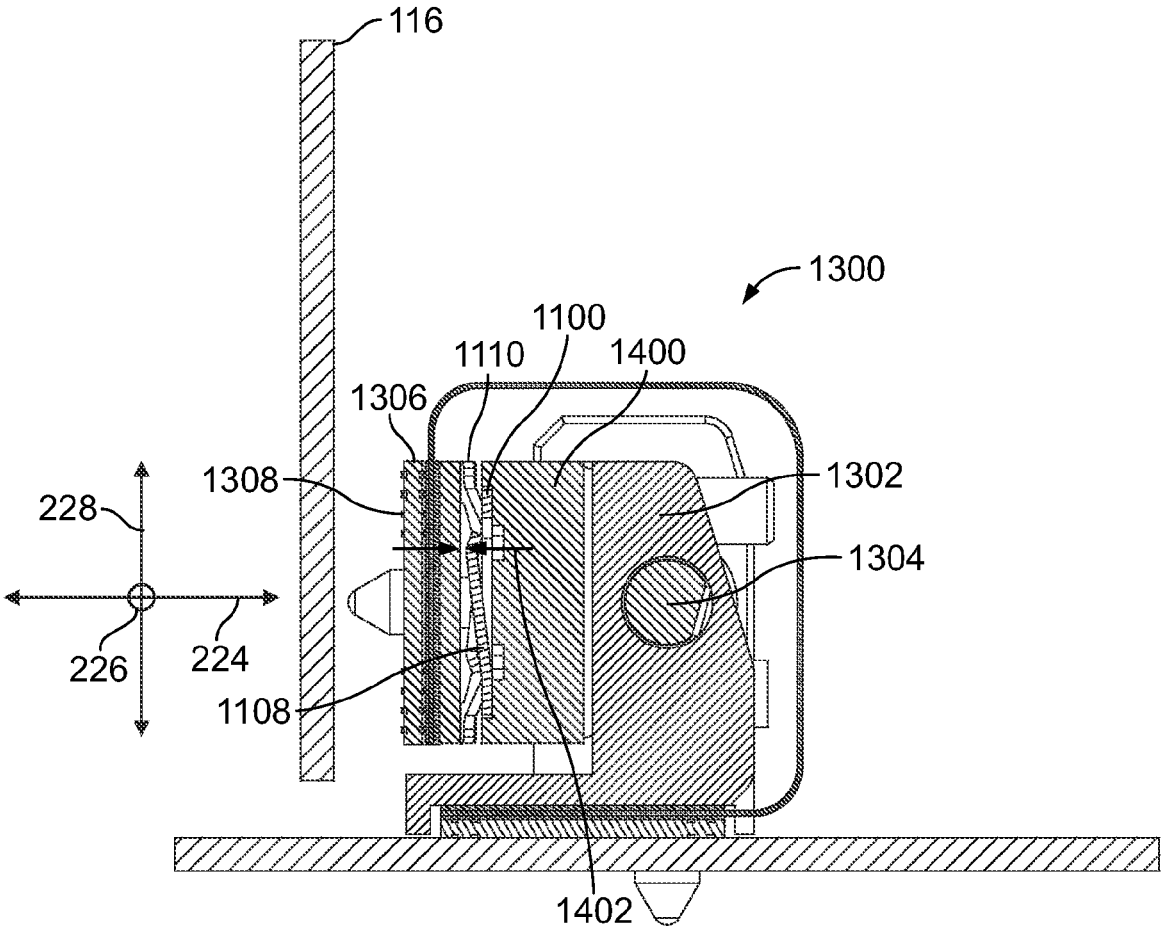
FIG. 15 is a cross-sectional view of the connector assembly shown in FIG. 13 in the unmated state of FIG. 14 along line B-B in FIG. 13.

FIG. 14 is a cross-sectional view of the connector assembly 1300 along line A-A in FIG. 13 when the mating array 1306 is unmated from the removable circuit board 116 in accordance with one embodiment. FIG. 15 is a cross-sectional view of the connector assembly 1300 shown in FIG. 14 along line B-B in FIG. 13 in the unmated state. The self-aligning subassembly 1100 may be joined to a header portion 1400 that is located within the housing 1302. Similar to the header portion 300 (shown in FIG. 3), the header portion 1400 is moved along the z-direction 224 toward the removable circuit board 116 by the actuator 1304 when the actuator 1304 is rotated. The self-aligning subassembly 1100 may be coupled to the header portion 1400 such that the loading and floating resilient bodies 1108, 1110 project toward the mating array 1306.

Similar to the floating resilient bodies 306 (shown in FIG. 3), the floating resilient bodies 1110 engage the mating array 1306 and permit the mating array 1306 to float or move relative to the housing 1302 in the x- and y-directions 226, 228 in order to align the terminals 1308 of the mating array 1306 with the terminals 124 (shown in FIG. 1) of the removable circuit board 116. The mating array 1306 may slide on the floating resilient bodies 1110 to become self-aligned with the removable circuit board 116. When the mating array 1306 is unmated or separated from the removable circuit board 116, a gap 1402 may exist between the loading resilient bodies 1108 and the mating array 1306. Alternatively, the loading resilient bodies 1108 may abut the mating array 218 such that no gap 1402 is provided.

Figure 16:
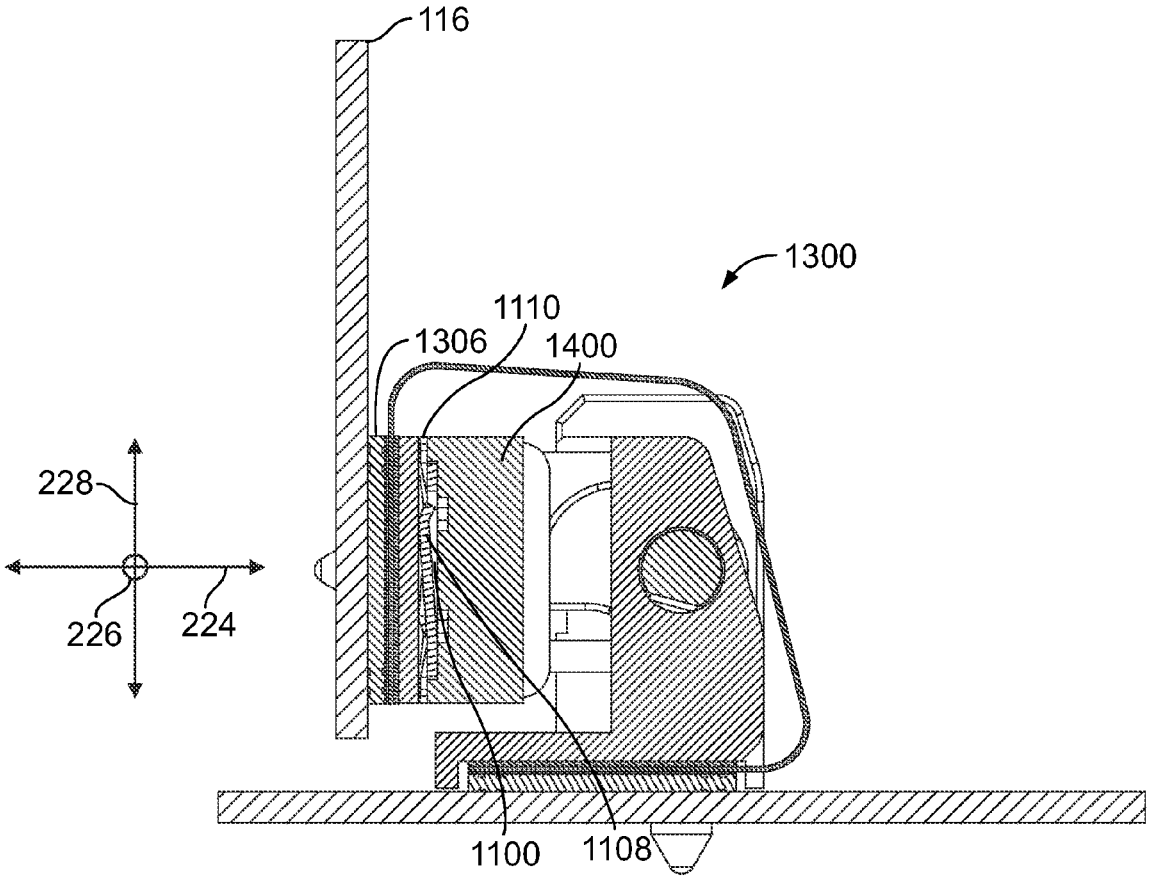
FIG. 16 is a cross-sectional view of the connector assembly shown in FIG. 13 in a mated state along line B-B of FIG. 13 in accordance with one embodiment.

FIG. 16 is a cross-sectional view of the connector assembly 1300 mated with the removable circuit board 116 along line B-B in FIG. 13 in accordance with one embodiment. As described above, the floating resilient bodies 1110 of the self-aligning subassembly 1100 engage the mating array 1306 and permit the mating array 1306 to float, or move in one or more of the x-, y-, and z-direction 226, 228, 224, relative to the removable circuit board 116 in order to align the mating array 1306 with respect to the removable circuit board 116. As the header portion 1400 continues to move in the z-direction 224, the beams 1110 continue to be compressed until the loading resilient bodies 1108 also engage the mating array 1306. Continued movement of the header portion 1400 in the z-direction 224 toward the removable circuit board 116 causes the loading resilient bodies 1108 to be compressed between the header portion 1400 and the mating array 1306. Compression of the loading resilient bodies 1108 causes the loading resilient bodies 1108 to impart a loading force on the mating array 1306 in the z-direction 224 toward the removable circuit board 116. Similar to as described above, this loading force mates the terminals 1308 on the mating array 1306 with the terminals 124 (shown in FIG. 1) of the removable circuit board 116.

Several embodiments described herein provide for different self-aligning subassemblies that provide different forces on the mating array in order to align the mating array with a removable circuit board and to couple the mating array with the circuit board. The self-aligning subassemblies may include one or more resilient bodies that provide the floating and/or loading forces. A single resilient member or several of the same type of resilient bodies may be included in a self-aligning subassembly to provide both of the floating and loading forces. For example, instead of having different floating and loading resilient bodies, a single resilient member may be used. The single resilient member may bend or flex to allow the mating array to self-align to the circuit board and be compressed to provide a loading force on the mating array that mates the terminals of the mating array with the terminals of the circuit board. By way of example only, the single resilient member may be one or more of the same type of helical springs having the same spring constants or a polymeric material disposed between the header portion and the mating array of the connector assembly. This single resilient member or single type of resilient member may be used to provide both the floating and loading forces described herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a housing configured to be joined to a first circuit board and including a header portion configured to move in a mating direction toward a second circuit board;

a mating array joined to the header portion and including an array terminal, the mating array moveable in the mating direction to couple the array terminal with a mating terminal of the second circuit board; and a self-alignment subassembly disposed between the header portion and the mating array, the self-alignment subassembly applying a resilient force on the mating array that permits alignment of the array terminal of the mating array with the mating terminal, wherein the resilient force permits the mating array to float in at least one direction that is approximately perpendicular to the mating direction as the mating array is moved in the mating direction to engage the second circuit board, the self-alignment subassembly also applying a loading force on the mating array in the mating direction that couples the array terminal of the mating array with the mating terminal.

2. The connector assembly of claim 1, wherein the self-alignment subassembly includes a floating resilient body and a separate loading resilient body, the floating resilient body imparting the resilient force on the mating array and the loading resilient body applying the loading force on the mating array.

3. The connector assembly of claim 2, wherein the loading resilient body imparts the loading force on the mating array when the loading resilient body is compressed between the mating array and the header portion.

4. The connector assembly of claim 2, wherein the floating resilient body bends to permit the mating array to float in the at least one direction that is approximately perpendicular to the mating direction.

5. The connector assembly of claim 1, wherein the self-alignment subassembly includes at least one of (a) one or more helical springs or (b) one or more spring washers.

6. The connector assembly of claim 1, wherein the self-alignment subassembly comprises an approximately planar body disposed between the mating array and the header portion with resilient bodies protruding from the planar body.

7. The connector assembly of claim 1, further comprising an actuator and a cam operatively coupled to the actuator, wherein the actuator moves the cam when the actuator is activated, the cam driving the header portion and the mating array in the mating direction when moved by the actuator.

8. The connector assembly of claim 7, wherein the actuator is rotatable between different positions.

9. The connector assembly of claim 1, wherein the loading force is increased after the mating array is permitted to float in the at least one direction that is approximately perpendicular to the mating direction.

10. The connector assembly of claim 1, wherein the mating array includes an alignment feature that has a fixed position with respect to the array terminal, the alignment feature configured to engage the second circuit board as the mating array approaches the second circuit board, the mating array floating in the at least one direction that is approximately perpendicular to the mating direction when the alignment feature engages the second circuit board.

11. A connector assembly comprising:

a housing having a mounting side configured to be joined to a first circuit board and including a header portion configured to move relative to the first circuit board in a mating direction toward a second circuit board;

a mating array interconnected with the header portion, the mating array including an array terminal configured to couple with a mating terminal of the second circuit board, the mating array configured to move in the mating direction to couple the array terminal with the mating terminal of the second circuit board;

a floating resilient body disposed between the mating array and the header portion, the floating resilient body applying a resilient force on the mating array that permits alignment of the array terminal of the mating array with the mating terminal, wherein the mating array is permitted to float in at least one direction that is approximately perpendicular to the mating direction as the mating array is moved in the mating direction to engage the second circuit board; and a loading resilient body disposed between the mating array and the header portion, the loading resilient body applying a loading force on the mating array that couples the array terminal of the mating array with the mating terminal when the loading resilient body is compressed.

12. The connector assembly of claim 11, wherein the floating resilient body permits movement of the mating array in any direction that is approximately perpendicular to the mating direction.

13. The connector assembly of claim 11, wherein the loading resilient body imparts the loading force to overcome a mating force required to couple the array terminal of the mating array with the mating terminal.

14. The connector assembly of claim 11, wherein at least one of the floating and resilient bodies includes at least one of (a) one or more helical springs; (b) one or more spring washers; or (c) one or more polymeric bodies.

15. The connector assembly of claim 11, wherein a gap exists between the loading resilient body and the mating array during an unmated state of the mating array, the loading resilient body being engaged to the mating array when the mating array is mated to the second circuit board.

16. The connector assembly of claim 11, wherein the loading force is increased after the mating array is permitted to float in the at least one direction that is approximately perpendicular to the mating direction.

17. A connector assembly comprising:

a housing having a mounting side configured to be joined to a first circuit board and including a header portion configured to move relative to the first circuit board along a mating direction toward a second circuit board;

a mating array interconnected with the header portion, the mating array including an array terminal configured to couple with a mating terminal of the second circuit board, the mating array configured to move in the mating direction to couple the array terminal with the mating terminal of the second circuit board; and a self-alignment subassembly disposed between the mating array and the header portion, the self-alignment subassembly including an approximately planar body with resilient bodies protruding from the planar body, the resilient bodies applying a resilient force on the mating array that permits alignment of the array terminal with the mating terminal and applying a loading force on the mating array in the mating direction that couples the array terminal with the mating terminal.

18. The connector assembly of claim 17, wherein the resilient bodies of the self-alignment subassembly include a floating resilient body and a separate loading resilient body, the floating resilient body imparting the resilient force on the mating array and the loading resilient body applying the loading force on the mating array.

19. The connector assembly of claim 17, wherein the resilient bodies comprise beams protruding from the body of the self-alignment subassembly.

20. The connector assembly of claim 17, wherein the mating array is permitted to slide on the resilient bodies in order to move in one or more directions that are approximately perpendicular to the mating direction as the mating array engages the second circuit board.

* * * * *